United States Patent [19]

Wagner et al.

[11] 4,223,548

[45] Sep. 23, 1980

[54] PROCESS AND DEVICE FOR EXTRUDING HOLLOW SECTIONS

[75] Inventors: Alfred Wagner, Steisslingen; Adolf Ames, Hilzingen, both of Fed. Rep. of Germany

[73] Assignee: Swiss Aluminium Ltd., Chippis, Switzerland

[21] Appl. No.: 20,253

[22] Filed: Mar. 14, 1979

[30] Foreign Application Priority Data

Mar. 23, 1978 [DE] Fed. Rep. of Germany ..... 2812690

[51] Int. Cl.[3] ..... B21C 23/01; B21C 25/00; B21C 29/04; B21C 31/00

[52] U.S. Cl. ..... 72/265; 72/264; 72/266; 72/269; 72/271

[58] Field of Search ..... 72/253, 264, 265, 266, 72/268, 269, 271, 467

[56] References Cited

U.S. PATENT DOCUMENTS

| | | | |
|---|---|---|---|
| 2,337,804 | 12/1943 | Dempsey | 72/265 |
| 2,491,897 | 12/1949 | Lorant | 72/265 |
| 3,213,662 | 10/1965 | Lenz | 72/269 |
| 3,455,137 | 7/1969 | Edgecombe | 72/264 |
| 3,675,457 | 7/1972 | Groos | 72/265 |
| 3,798,954 | 3/1974 | Asari | 72/265 |

FOREIGN PATENT DOCUMENTS

| | | | |
|---|---|---|---|
| 48-19782 | 6/1973 | Japan | 72/264 |
| 395906 | 7/1933 | United Kingdom | 72/265 |
| 461751 | 8/1975 | U.S.S.R. | 72/264 |
| 489547 | 1/1976 | U.S.S.R. | 72/264 |
| 504574 | 5/1976 | U.S.S.R. | 72/264 |

*Primary Examiner*—Lowell A. Larson
*Attorney, Agent, or Firm*—Bachman and LaPointe

[57] ABSTRACT

A process for the extrusion of tubes or similar hollow sections from a billet is disclosed within the billet is forced against a hollow extrusion die surrounding a mandrel and a mandrel support. A core passing through the extrusion billet moves in the direction of extrusion with the billet and is led through the mandrel into the space inside the resultant hollow section. The process of the present invention relieves the die of the high stresses which can otherwise lead to early failure of the die.

20 Claims, 8 Drawing Figures

PROCESS AND DEVICE FOR EXTRUDING HOLLOW SECTIONS

BACKGROUND OF THE INVENTION

The present invention is drawn to a process and a device for extruding tubes or similar hollow sections from a billet wherein the billet is forced by an extrusion stem against a die, in particular against a multi-chamber die with welding zone, wherein the die surrounds a mandrel on a mandrel support.

There are multi-chamber dies with welding zone in which the entry orifices are positioned around the mandrel which determines the shape of the interior of the hollow section produced. The mandrel is mounted on a system of struts in the die which form a mandrel support and must withstand very large forces which increase with a corresponding increase in the cross section or size or circumscribing circle. Such a system suffers from a number of disadvantages, in particular when manufacturing large tubes which frequently leads to fracturing of the mandrel support.

Accordingly, it is the principal object of the present invention to provide an improved process and device for extruding hollow sections in which, during the extrusion operation, there is less load on the mandrel support and consequently an increase in the lifetime of the extrusion tool under optimum use of the extrusion force.

Further objects and advantages of the present invention will appear hereinbelow.

SUMMARY OF THE INVENTION

In accordance with the present invention, the foregoing objects and advantages are readily obtained by way of a process in which a core or the like, passing through the billet, moves with the billet in the direction of extrusion and is led through the mandrel into the space inside the resultant hollow section, the diameter of which is relatively large—in terms of the size of the extrusion press. According to other features of the process of the present invention, the speed of movement of the core can correspond to or differ from that of the extrusion stem.

A device which is suitable for carrying out this process features a core which moves in the direction of extrusion and passes through the billet. The core is positioned coaxially in an opening in the mandrel support in which it can slide.

The core can, in terms of the present invention, either be fixed to the extrusion stem or, passing through this, be connected to a special pushing facility. In the first mentioned case the speed of movement of the core and the speed of movement of the stem are linked. In the other case, the same speed can be employed, or faster or slower relative speeds can be employed under controlled conditions.

With controlled relative movement between the extruded product and the core or between the core and the extrusion stem one can, for example, advantageously influence the flow characteristics of the extruded metal in the whole container by means of the friction between the hollow billet and the core. This is particularly so if the relative movements can be altered, if desired automatically, during the extrusion process.

To understand how the present invention improves the flow characteristics of the billet, it is first necessary to appreciate that in a conventional extrusion press the component of velocity of the billet in the direction of its extrusion, here called the horizontal component of velocity, is not uniform transversely to the direction of extrusion of the billet.

The horizontal component of velocity decreases near to a stationary wall of a peripheral container for the billet because material of the billet near the wall is retarded by friction. When the billet has been almost fully extruded, the material of the billet near the wall has a tendency to flow backwards and towards the middle of the billet. It is found that "dirty" material from the periphery of the billet appears in the final extruded product. As it is essential to maintain high product quality, the last part of the billet is not extruded but is left as a butt. The greater the difference between the horizontal components of velocity at the center and the periphery of the billet, the greater is the thickness of the butt which must be left and thus the smaller is the yield per billet.

These disadvantages are largely offset by the present invention, however, because of the frictional effect of the movable core on the material of the billet adjacent thereto. By increasing or decreasing the relative speed of movement of the core, the surrounding material of the billet is either accelerated or retarded. In other words the flow pattern (distribution of horizontal components of velocity) can be optimized by means of controlled movement of the core.

In practice, at the beginning of extrusion an increased core speed will take the surrounding material of the billet with it, contributing to the work being carried out by the extrusion stem and leading to a faster flow of the billet through the extrusion tool. It is found that this in turn leads to a reduction in the pressure exerted on the extrusion tool, and in particular the mandrel support, because the material of the billet being extruded has less time to cool. Towards the end of extrusion a decreased core speed will retard the surrounding material of the billet. This serves to counteract both the accelerated movement of the center of the billet and the backward movement of the periphery of the billet. A more uniform flow pattern of the material of the billet is thus obtained at the entry to the extrusion tool. A result of this is that the required butt size is smaller giving a better yield per billet.

Thanks to the possibility of controlling the core, the force of compression acting on the die can be kept uniform from the start to the end of the extrusion stroke and the load on the mandrel support diminished. Furthermore, as already explained, a higher extrusion rate can be achieved which considerably improves the economics of the process.

As a result of the present invention it is also possible with existing extrusion presses, and therefore given extrusion force, to employ a container of larger diameter bore or calibre without changing the ratio of container cross section to extrusion force which is decisive for the shaping of the product. This means that larger calibre hollow sections can be produced on these given presses.

Furthermore, it is also possible to improve the extrusion ratio by reducing the container cross section around the core cross section in the case of given container diameter or calibre, and therefore to produce on an existing press hollow sections in alloys which are difficult to extrude.

Special shell-like bearings can be provided at the bearing points on the core in the extrusion press which will minimise wear at places of contact. These bearing components are, according to another feature of the present invention, employed to maintain a straight line of movement of the core.

It is also within the scope of the present invention to provide heating elements in the core so as to influence the flow characteristics of the metal being extruded. If necessary, facilities for cooling can be incorporated instead of heating elements.

BRIEF DESCRIPTION OF THE DRAWINGS

Further advantages, features and details of the present invention are revealed in the following description of preferred, exemplified embodiments and with the help of the drawings wherein.

DETAILED DESCRIPTION

Figure 1:
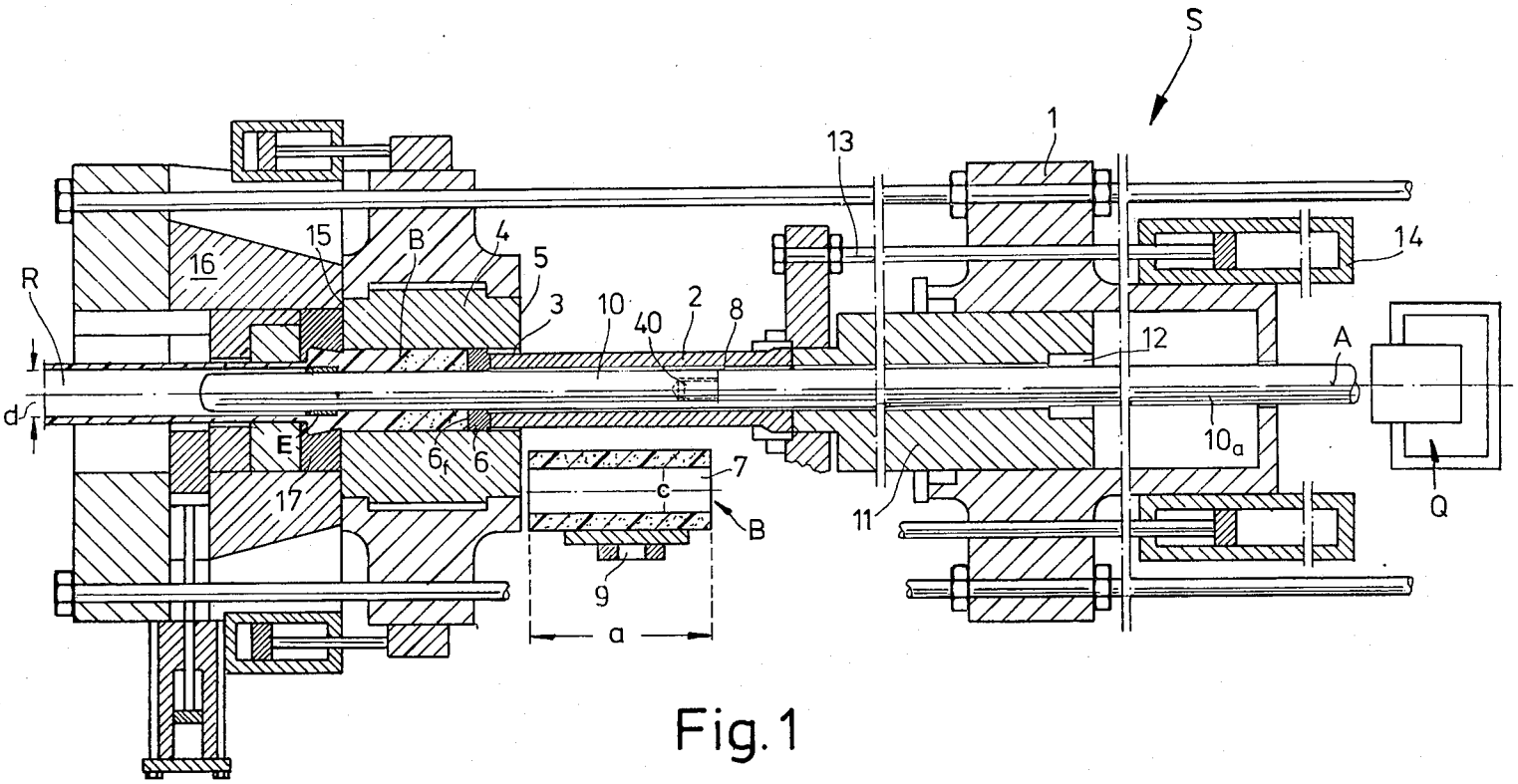
FIG. 1: Is a longitudinal cross section through an extrusion press with a horizontal core.

FIG. 1 illustrates an extrusion press S for manufacturing tubes R or similar hollow bodies of relatively large diameter d. This press S features a hollow extrusion stem 2 on a ram cross head 1, with the stem 2 projecting into an opening 3 in a billet container 4. The maximum distance a between the end 5 of the container 4 facing the ram cross head 1 and the working face $6_f$ of the dummy block 6 mounted on the stem 2, before the beginning of extrusion, a condition not shown here is such that a hollow extrusion billet B of light weight metal, with an inner bore of diameter c, can be fed to the press S by means of a loading device 9 and then in the direction of extrusion x into the opening 3 in the container 4.

A horizontal core 10 of diameter e is provided in the container opening 3 along the principle axis A of the press S, passing through the opening 8 in the hollow extrusion stem 2 and the space 7 inside the hollow billet B. This core 10 can be pushed through the cylinder 11 of the ram 1 and through the bearing 12 of the cylinder 11, which is connected to the hydraulic drives 14 via piston rods 13.

Near the hydraulic drives 14 there is specially designed hydraulic equipment Q which has a facility for pushing the core 10, so that it can move with respect to the stem 2 and its cylinder 11. Furthermore, the core 10 can be moved in such a manner as to allow the ingot butt to be sheared off and to allow loading or reloading of the container 4, and can be withdrawn at least partly into the stem 2.

A die 17 is provided in a die ring 16 at the end 15 of the container 4 away from the stem 2.

Figure 2:
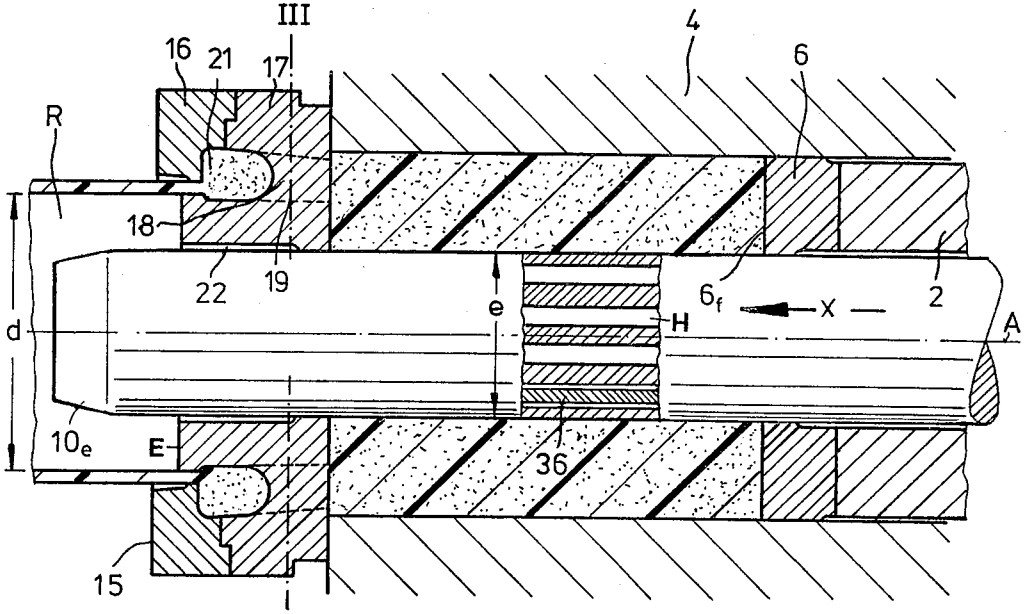
FIG. 2: Is an enlarged detail from FIG. 1.
Figure 3:
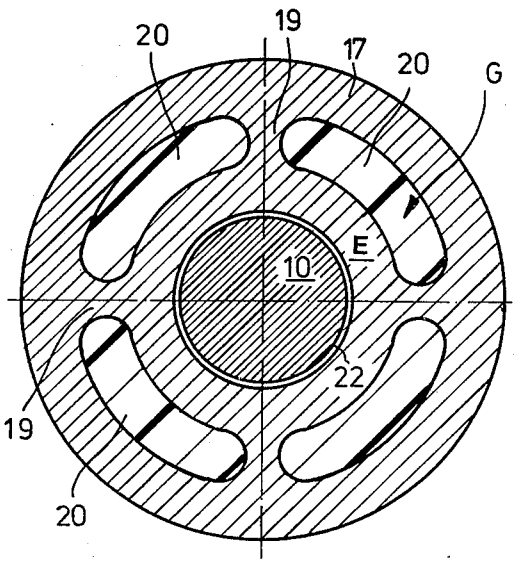
FIG. 3: Is a cross section through FIG. 2 along line III—III.

As is shown particularly well in FIG 2, at the centre of the die 17, there is a die mandrel E which determines the inner diameter d of the resultant tube R. This mandrel E is held by struts 18 which make up a mandrel support 19 and separate arc-shaped openings 20 via which the metal being extruded reaches the adjacent, downstream welding zone 21. This zone lies between the die 17 and the mandrel E in which the horizontal core 10 lies in a central opening 22.

As the stem 2 penetrates the billet B, the core 10 moves forward through the mandrel E at the speed determined by the ram 1 or the hydraulic drive Q. The mandrel E is held, in FIG. 4, on the mandrel support 19 by means of a ring 28 and a threaded ring 26. This latter component 26 is provided with bearings 25 for the core 10.

Figure 4:
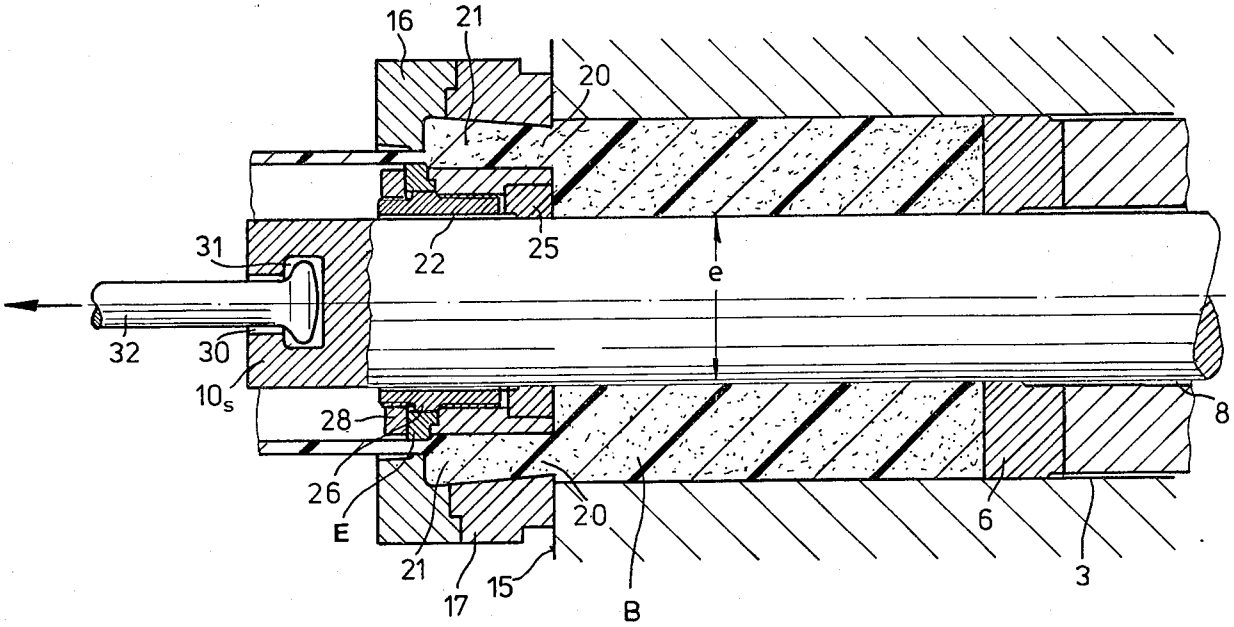
FIG. 4: Is another exemplified embodiment of an extrusion press showing the same view as in FIG. 2.
Figure 8:
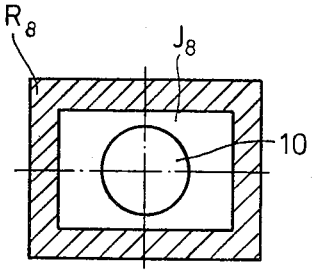
FIGS. 5 to 8: Is a cross sections of extrusion sections, each surrounding the core used in their manufacture.
Figure 5:
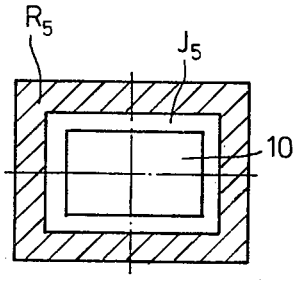
Figure 6:
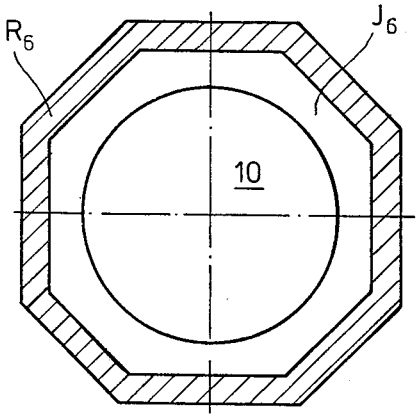
Figure 7:
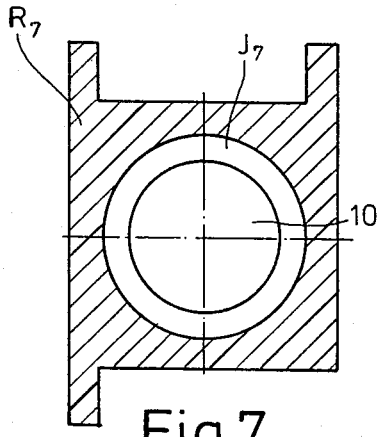

In the embodiment shown in FIG. 4 there is also a central recess 30 with an undercut part 31 provided in the end face $10_s$ of the core 10. In this case the hydraulic drive Q, described in connection with the other versions, it not used; instead, a rod 32 is introduced into the undercut part 31 of the recess 30, if the core 10 is to be pulled at least partially in the direction of extrusion x out of the container 4 at the end of an extrusion stroke, for example to allow the butt to be sheared off without hindrence. In doing so, the front 5 of the container 4 is again free to allow unimpeded insertion of the billet B into the interior 7 of which the core 10 can be pushed by means of the rod 32.

Channels H are provided in the tapering end $10_e$ of the core 10 in FIG. 2; these channels accommodate heating elements 36, the electrical connections of which are not shown here.

The hollow billet B is, as described, inserted into the opening 3 in the container 4 before the extrusion stroke, and the core 10 introduced into the interior 7 of the hollow billet B.

The product G produced from the billet B under the pressure of the stem 2 flows through the opening 20 in the die 17 and forms the tube R around the mandrel E in the welding zone 21 of the die 17. During this time, the core 10 slides in the central opening 22 in the mandrel E. This takes place either at the speed of movement of the ram, especially in the case of cores 10 which are fixed to the stem 2, or at the flow rate of metal flow of the billet material inside the container due to the friction between said billet and said core in the case of a "floating" core 10; if the power unit Q is employed, then the speed of the core 10 can be chosen at will.

To allow better handling, the core 10 can be divided, as shown in FIG. 1, the end piece $10_a$, in terms of the direction of extrusion, is connected to the front piece via coupling 40.

FIGS. 5 to 8 show in cross section box-like or multi-sided sections $R_5$ to $R_8$ in the interiors $J_5$ to $J_8$ cores 10 of various cross-sectional shape are situated.

We claim:

1. A method for extruding hollow sections or the like comprising:

loading a hollow billet into a container;

locating an extrusion tool comprising a die, a hollow mandrel and a mandrel support at the end of said container such that said die surrounds said hollow mandrel;

moving a hollow stem in a first direction into said container from the opposite end thereof so as to urge said billet through said die so as to form said hollow section; and passing a core through said stem, said hollow billet and said hollow mandrel thereby reducing the high stresses on said hollow mandrel and said mandrel support.

2. A method according to claim 1 wherein the core moves at a speed equal to the speed of said stem.

3. A method according to claim 1 wherein the core moves at a speed equal to the flow rate of the extruded billet.

4. A method according to claim 1 wherein the core moves at a speed different from the speed of said ram.

5. A method according to claim 4 further including means independent of said stem for moving said core.

6. A method according to claim 5 wherein said means for moving said core is controlled and altered automatically during the extrusion of said billet.

7. A method according to claim 1 wherein said core is passed through said billet in frictional contact therewith so as to aid in the extrusion of said billet.

8. A method according to claim 1, further including heating means provided in said core so as to alter the flow characteristics of said billet during the extrusion thereof.

9. A method according to claim 1 further including cooling means provided in said core so as to alter the flow characteristics of said billet during the extrusion thereof.

10. An apparatus for extruding hollow sections or the like comprising:

an extrusion tool comprising a hollow mandrel, a die which surrounds said hollow mandrel and a mandrel support;

stem means positioned with respect to said extrusion tool and movable in a first direction for forcing a hollow billet therethrough; and core means movable in said first direction through said stem, said hollow billet and said hollow mandrel whereby said core aids in the extrusion of said billet while at the same time reducing stresses on said hollow mandrel and said mandrel support.

11. An apparatus according to claim 10 wherein the diameter of said core is substantially equal to the inner diameter of said hollow billet wherein said stem comprises a ram face and a hollow extrusion stem and said core is positioned within said hollow stem.

12. An apparatus according to claim 11 wherein said core is fixed to said stem.

13. An apparatus according to claim 11 wherein said core further includes means for moving said core independently of said stem.

14. An apparatus according to claim 13 wherein said means comprises an automatic control unit for changing the speed and/or direction of movement from said core.

15. An apparatus according to claim 10 wherein said extrusion tool comprises shell-like bearing means for supporting said core.

16. An apparatus according to claim 15 wherein said shell-like bearing means can be moved so as to allow adjustment of said core.

17. An apparatus according to claim 10 wherein said mandrel is separable from said die.

18. An apparatus according to claim 10 wherein a portion of said core is hollow and comprises means for altering the flow characteristics of said billet.

19. An apparatus according to claim 18 wherein said means for altering the flow characteristics of said billet comprises heating means.

20. An apparatus according to claim 18 wherein said means for altering the flow characteristics of said billet comprises cooling means.

* * * * *

UNITED STATES PATENT AND TRADEMARK OFFICE

CERTIFICATE OF CORRECTION

PATENT NO. : 4,223,548

DATED : September 23, 1980

INVENTOR(S) : Alfred Wagner and Adolf Ames

It is certified that error appears in the above-identified patent and that said Letters Patent are hereby corrected as shown below:

In the Abstract, line 2, change "within" to --wherein--.

Column 1, line 19, change "or" to --of--.

Column 4, claim 4, line 68, change "ram" to --stem--.

Column 5, claim 8, line 9, after "1" delete ",".

Signed and Sealed this

Ninth Day of December 1980

[SEAL]

Attest:

SIDNEY A. DIAMOND

Attesting Officer

Commissioner of Patents and Trademarks